US009171501B2

(12) United States Patent
Huang et al.

(10) Patent No.: US 9,171,501 B2
(45) Date of Patent: Oct. 27, 2015

(54) AMOLED PIXEL STRUCTURE WITH A SUBPIXEL DIVIDED INTO TWO SECONDARY SUBPIXELS

(71) Applicant: CHUNGHWA PICTURE TUBES, LTD., Taoyuan (TW)

(72) Inventors: Chin-Hai Huang, Taoyuan County (TW); Szu-Chi Huang, Changhua County (TW); Chun-Lin Chen, Taichung (TW)

(73) Assignee: CHUNGHWA PICTURE TUBES, LTD., Taoyuan (TW)

( * ) Notice: Subject to any disclaimer, the term of this patent is extended or adjusted under 35 U.S.C. 154(b) by 80 days.

(21) Appl. No.: 14/109,932

(22) Filed: Dec. 17, 2013

(65) Prior Publication Data

US 2015/0109188 A1 Apr. 23, 2015

(30) Foreign Application Priority Data

Oct. 21, 2013 (TW) ..... 102137930 A

(51) Int. Cl.
*G09G 3/32* (2006.01)

(52) U.S. Cl.
CPC ..... *G09G 3/3225* (2013.01); *G09G 2300/0452* (2013.01)

(58) Field of Classification Search
CPC ..... G09G 3/3233; G09G 3/3225; G09G 2300/0452
See application file for complete search history.

(56) References Cited

U.S. PATENT DOCUMENTS

| | | | | |
|---|---|---|---|---|
| 9,094,679 | B2 * | 7/2015 | Shin | G02F 1/33528 1/1 |
| 2003/0016318 | A1 * | 1/2003 | Liang et al. | 349/106 |
| 2004/0080479 | A1 | 4/2004 | Credelle | |
| 2007/0002084 | A1 * | 1/2007 | Kimura et al. | 345/694 |
| 2007/0075627 | A1 * | 4/2007 | Kimura et al. | 313/503 |
| 2012/0139978 | A1 * | 6/2012 | Ikeda | 345/694 |
| 2013/0141481 | A1 * | 6/2013 | Peng et al. | 345/694 |

FOREIGN PATENT DOCUMENTS

TW M448103 3/2013

* cited by examiner

*Primary Examiner* — Liliana Cerullo
(74) *Attorney, Agent, or Firm* — CKC & Partners Co., Ltd.

(57) ABSTRACT

An active matrix organic light emitting diode pixel (AMOLED) pixel structure includes a plurality of sub pixels, wherein at least one of the sub pixels comprises two secondary sub pixels, and the secondary sub pixels are disposed with organic light emitting materials with different light emitting characteristics respectively, so that lights emitted from the secondary sub pixels are mixed to adjust the performance of the sub pixels.

14 Claims, 5 Drawing Sheets

AMOLED PIXEL STRUCTURE WITH A SUBPIXEL DIVIDED INTO TWO SECONDARY SUBPIXELS

RELATED APPLICATIONS

This application claims priority to Taiwanese Application Serial Number 102137930, filed Oct. 21, 2013, which is herein incorporated by reference.

BACKGROUND

1. Field of Invention

The present invention relates to an organic light emitting diodes (OLED) pixel structure. More particularly, the present invention relates to an active matrix organic light emitting diodes (AMOLED) pixel structure.

2. Description of Related Art

Display devices employing electroluminescent display elements, such as organic light emitting diodes (OLEDs), have become a popular choice among flat panel displays. OLED displays are used as television screens, computer monitors, portable electronic systems such as mobile phones and personal digital assistants (PDAs). An OLED is a light emitting diode (LED), wherein the emissive electroluminescent layer is a film of organic compounds which emit light in response to an electric current. The emissive electroluminescent layer is situated between two electrodes. Generally, at least one of these electrodes is transparent. An OLED display functions without a backlight. Thus, the OLED display can display deep black levels and can also be thinner and lighter than other flat panel displays such liquid crystal displays (LCDs). OLED displays can use either passive matrix addressing scheme, which is called passive matrix organic light emitting diodes (PMOLED), or active matrix addressing scheme, which is called a (AMOLED). AMOLED is more suitable for higher resolution and larger size displays.

An AMOLED display normally includes a circuit layer formed on a substrate such as glass and an emissive electroluminescent layer formed on the circuit layer. The emissive electroluminescent layer includes a plurality of regularly-spaced pixels positioned in a display area in a form of a matrix with a plurality of rows and a plurality of columns. For color displays, each pixel may further include three sub pixels that emit red, green, and blue (RGB) light, respectively. In this arrangement, each pixel includes three sub pixels arranged as an array in the row direction. Sub pixels of the same color are arranged as continuous stripes in the column direction.

Due to different characteristics of organic light emitting materials of the RGB sub pixels, the RGB sub pixels have light emitting performances, respectively. For example, an AMOLED display may have high brightness but poor color saturation or using high power; other AMOLED display may have broad color field but poor tone; another AMOLED display may have good gamma precision but scarifying the brightness of the AMOELED display.

SUMMARY

An aspect of the invention provides an active matrix organic light emitting diode pixel structure. The AMOLED pixel structure includes a plurality of sub pixels, wherein at least one of the sub pixels comprises two secondary sub pixels, and the secondary sub pixels are disposed with organic light emitting materials with different light emitting characteristics respectively, so that the secondary sub pixels emit different lights.

In one or more embodiments, the secondary sub pixels in the sub pixel having the secondary sub pixels are driven by the same data line simultaneously.

In one or more embodiments, the secondary sub pixels in each sub pixel having the secondary sub pixels are disposed with organic light emitting materials with different efficiencies.

In one or more embodiments, the secondary sub pixels in each sub pixel having the secondary sub pixels are disposed with organic light emitting materials with different tones.

In one or more embodiments, the secondary sub pixels in each sub pixel having the secondary sub pixels are disposed with organic light emitting materials with different colors.

In one or more embodiments, an area of each of the secondary sub pixels in the sub pixel having the secondary sub pixels is the same.

In one or more embodiments, an area of each of the secondary sub pixels in the sub pixel having the secondary sub pixels is different from each other.

In one or more embodiments, the AMOLED pixel structure further comprises a plurality of driving thin film transistors for driving the secondary sub pixels.

In one or more embodiments, the size of each of the driving thin film transistors is the same.

In one or more embodiments, the size of each of the driving thin film transistors is different from each other.

In one or more embodiments, the secondary sub pixels in each sub pixel having the secondary sub pixels are divided by a data line.

In one or more embodiments, the secondary sub pixels in each sub pixel having the secondary sub pixels are divided by a scan line.

In one or more embodiments, each sub pixel having the secondary sub pixels is disposed with a data line and two scan lines, and the scan lines are arranged corresponding to the secondary sub pixels.

DESCRIPTION OF THE EMBODIMENTS

The term of "pixel" itself in the following disclosure is regarded as the minimize display unit in a display, e.g. a single point displayed in a display, which can also be regarded as the repeating color arrangement of the light emitting materials in the light emitting layer. Each "pixel" includes a plurality of "sub pixel", wherein each of the sub pixels can be driven by a driving thin film transistor individually. In the reality application, the display includes a huge number of pixels, and the number of the pixels is related to the desired resolution. A single pixel is discussed in the following disclosure for easy understanding the spirit of the disclosure.

The present disclosure provides an active matrix organic light emitting diode (AMOLED) display structure, wherein secondary sub pixels in the sub pixel are disposed with organic light emitting materials with different light emitting characteristics respectively. The ratio and/or composition of the organic light emitting materials can be adjusted for providing better gray tone, luminance, and color saturation.

Figure 1:
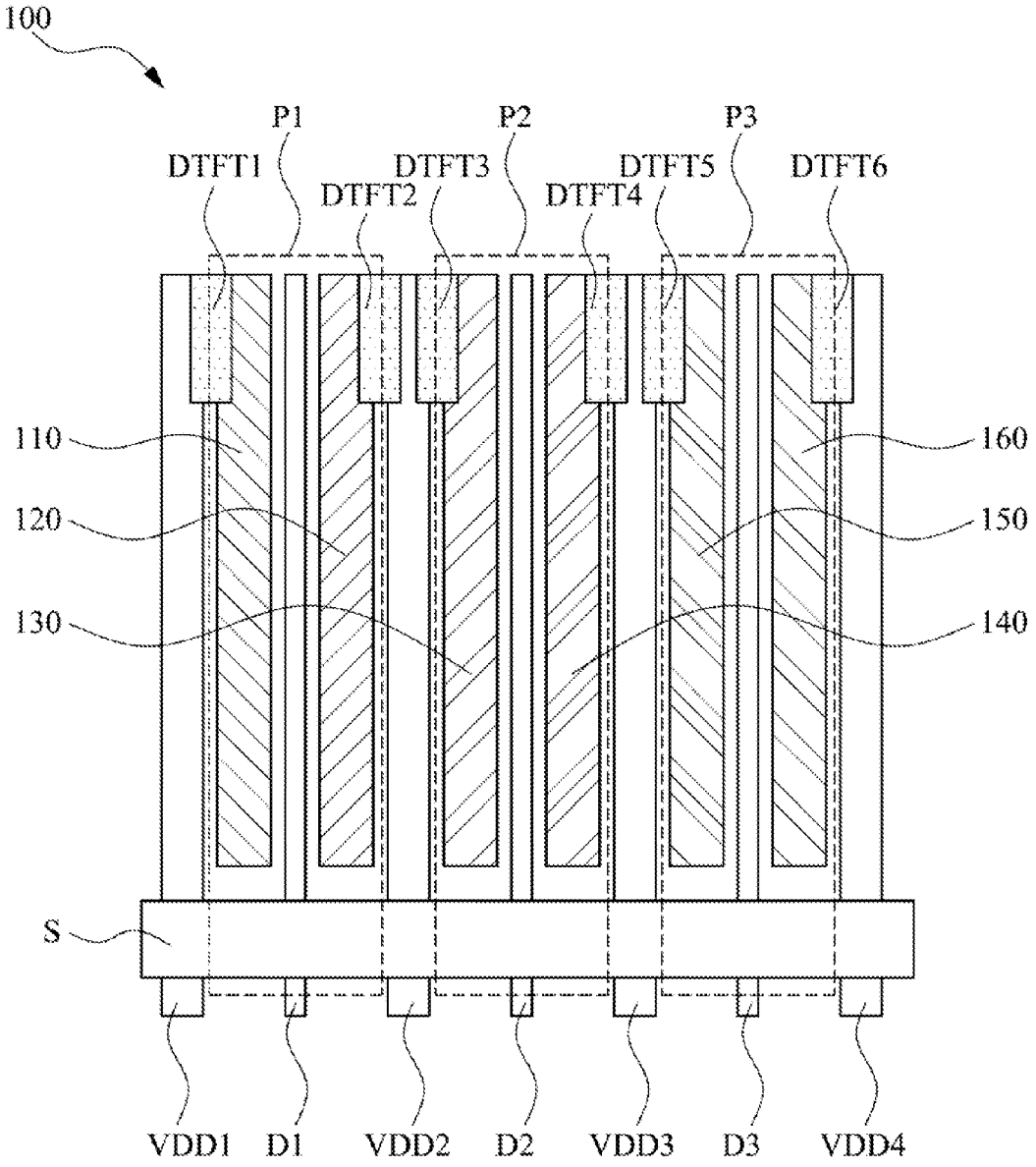
FIG. 1 to FIG. 5 are top views of different embodiments of an active matrix organic light emitting diode (AMOLED) pixel structure of the invention.

FIG. 1 is a top view of an embodiment of an active matrix organic light emitting diode (AMOLED) pixel structure of the invention. The AMOLED pixel structure 100 includes a scan line S, four power lines VDD1, VDD2, VDD3, and VDD4 cross the scan line S and are parallel to each other, and three data lines D1, D2, and D3 cross the scan line S and are parallel to each other. The power lines VDD1-VDD4 and the data lines D1-D3 are alternately arranged, wherein the data line D1 is arranged between the power lines VDD1 and VDD2, the data line D2 is arranged between the power lines VDD2 and VDD3, and the data line D3 is arranged between the power lines VDD3 and VDD 4.

The AMOLED pixel structure 100 in this embodiment includes a first sub pixel P1, a second sub pixel P2, and a third sub pixel P3. The first sub pixel P1 is defined by the scan line S and the data line D1, the second sub pixel P2 is defined by the scan line S and the data line D2, and the third sub pixel P3 is defined by the scan line S and the data line D3. The first sub pixel P1, the second sub pixel P2, and the third sub pixel P3 are arranged at the same side of the scan line S. The first sub pixel P1 is arranged between the power lines VDD1 and VDD2, the second sub pixel P2 is arranged between the power lines VDD2 and VDD3, and the third sub pixel P3 is arranged between the power lines VDD3 and VDD4.

The first sub pixel P1, the second sub pixel P2, and the third sub pixel P3 are further divided into two secondary sub pixels respectively by the data lines D1-D3. For example, the first sub pixel P1 is divided into a first secondary sub pixel 110 and a second secondary sub pixel 120 by the data line D1, the second sub pixel P2 is divided into a third secondary sub pixel 130 and a fourth secondary sub pixels 140 by the data line D2, and the third sub pixel P3 is divided into a fifth secondary sub pixel 150 and a sixth secondary sub pixel 160 by the data line D3. The first secondary sub pixel 110 to the sixth secondary sub pixel 160 are arranged parallel to each other. Namely, the first sub pixel P1 is divided by the first data line D1 vertically, the second sub pixel P2 is divided by the data line D2 vertically, and the third sub pixel P3 is divided by the data line D3 vertically. The first secondary sub pixel 110 to the sixth secondary sub pixel 160 are arranged at the same side of the scan line S.

Different characteristics of organic light emitting materials would bring different performances. For example, generally speaking, the organic light emitting material with light color may have better light emitting efficiency (e.g. having higher brightness in the same current density), and the organic light emitting material with dark color may have better chromaticity coordinate (color saturation). Therefore, the secondary sub pixels in the single sub pixel are arranged with organic light emitting materials with different light emitting efficiency and/or chromaticity. The ratio and/or composition of the organic light emitting materials can be adjusted for providing better gray tone, luminance, and color saturation.

For example, the first sub pixel P1 is corresponding to the color of red (R), wherein the first secondary sub pixel 110 in the first sub pixel P1 can be corresponding to dark red, and the second secondary sub pixel 120 in the first sub pixel P1 can be corresponding to light red. The second sub pixel P2 is corresponding to the color of green (G), wherein the third secondary sub pixel 130 in the second sub pixel P2 can be corresponding to dark green, and the fourth secondary sub pixel 140 in the second sub pixel P2 can be corresponding to light green. The third sub pixel P3 is corresponding to the color of blue (B), wherein the fifth secondary sub pixel 150 in the third sub pixel P3 can be corresponding to dark blue, and the sixth secondary sub pixel 160 in the third sub pixel P3 can be corresponding to light blue.

The individual area of the first secondary sub pixel 110 to the sixth secondary sub pixel 160 can be the same or be different from each other according to different design consideration. Namely, the area ratio and the material of the secondary sub pixels 110-160 in each sub pixel P1-P3 can be the modified flexibly according to a target color performance.

The AMOLED pixel structure 100 further includes a plurality of switches for controlling the current passing through the secondary sub pixels 110-160 thereby turning on or off the secondary sub pixels 110-160. The switches can be driving thin film transistors DTFT1-DTFT6. The driving thin film transistors DTFT1-DTFT6 are utilized for driving the first secondary sub pixel 110 to sixth secondary sub pixel 160 respectively.

In order to better mix the color from the secondary sub pixels 110-160 in the sub pixels P1-P3 for adjusting the color performance, the secondary sub pixels 110-160 in the sub pixels P1-P3 are preferably driven in the same time. For example, the first secondary sub pixel 110 and the second secondary sub pixel 120 are driven simultaneously; the third secondary sub pixel 130 and the fourth secondary sub pixel 140 are driven simultaneously; the fifth secondary sub pixel 150 and the second secondary sub pixel 160 are driven simultaneously. Therefore the first pixel P1, the second pixel P2, and the third pixel P3 may show the adjusted color.

As discussed above, not only the composition and/or the area ratio of the secondary sub pixels 110-160 can be utilized for providing the sub pixels P1-P3 different light emitting characteristics, the size of the driving thin film transistors DTFT1-DTFT6 can be designed for adjusting the light emitting strength of the secondary sub pixels 110-160. Therefore the size of the secondary sub pixels 110-160 can be modified according to different design requirement. Namely, the size of the secondary sub pixels 110-160 can be the same or different.

If the material characteristic of any color is pretty good and need not be adjusted, other color, such as yellow, may be inserted in that sub pixel for increasing brightness or color field. For example, if the performance of the green color (second sub pixel P2) is pretty ideal, the third secondary sub pixel 130 can be disposed with the light emitting material for emitting green light, and the fourth pixel 140 can be disposed with light emitting material for emitting yellow light in order to increase brightness or color field.

Although there are three data lines D1-D3, four power lines VDD1-VDD4, one scan line S, and three sub pixels P1-P3 (in an array of 1*3) illustrated in this embodiment, the present disclosure should not be limited in this embodiment and the following embodiments, a person of ordinary skill in the art may modify according to different requirements.

In some embodiments, each of the sub pixels P1-P3 is divided into two secondary sub pixels vertically by the data lines D1-D3. In some embodiments, only a part of the sub pixels are divided, or the sub pixel can be divided by other arrangement. Details thereof are discussed in following.

Figure 2:
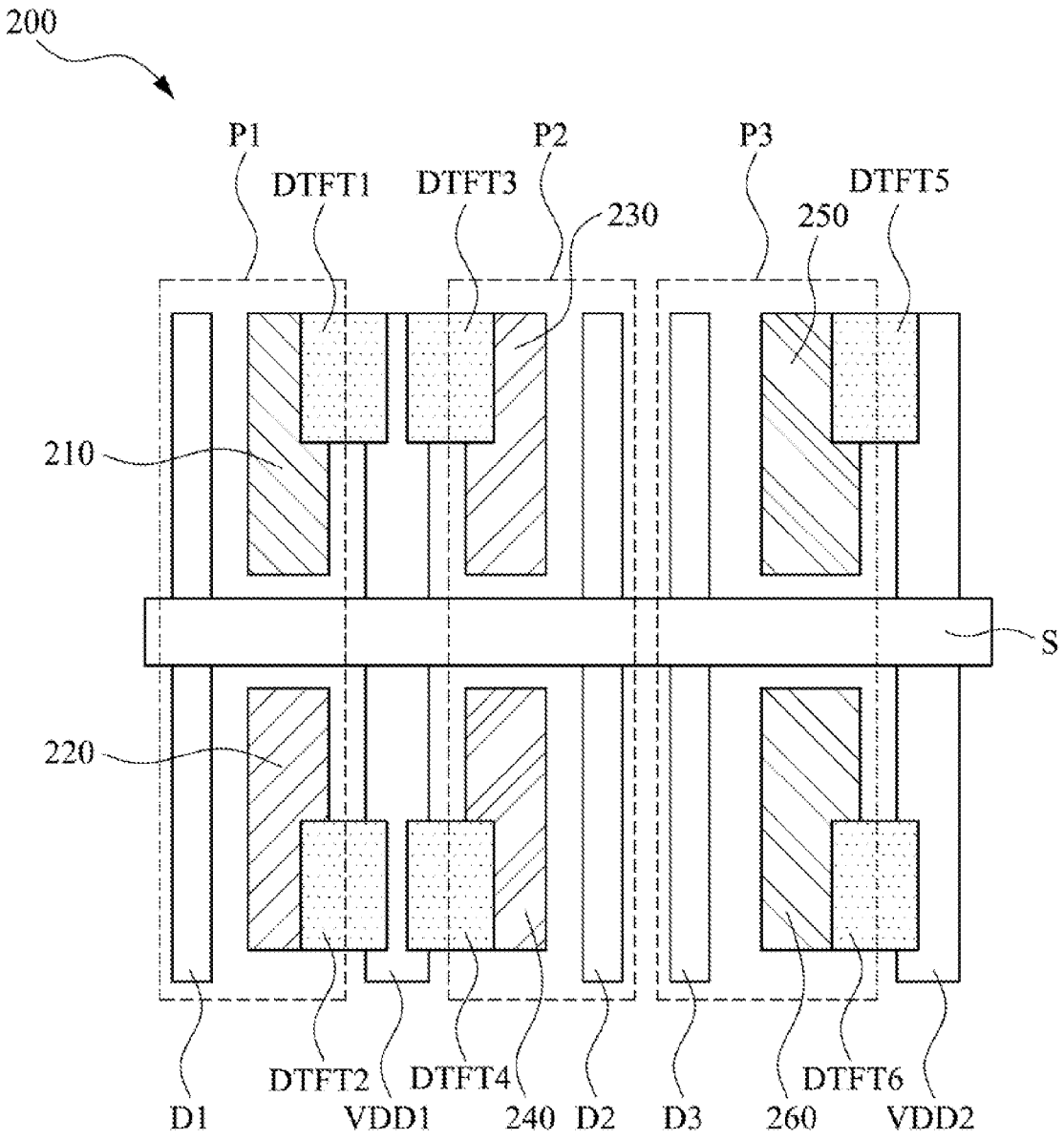

FIG. 2 is a top view of another embodiment of an AMOLED pixel structure of the invention. The AMOLED pixel structure 200 includes a scan line S, two power lines VDD1, VDD2 cross the scan line S and are parallel to each other, and three data lines D1, D2, and D3 cross the scan line S and are parallel to each other. The power line VDD1 is arranged between the data lines D1 and D2. The data line D3 is arranged next to the data line D2. The power lines VDD2 and VDD1 are arranged at opposite sides of the data line D2 and the data line D3.

The AMOLED pixel structure 200 in this embodiment includes a first sub pixel P1, a second sub pixel P2, and a third sub pixel P3. The first sub pixel P1 is defined by the scan line S and the data line D1, the second sub pixel P2 is defined by the scan line S and the data line D2, and the third sub pixel P3 is defined by the scan line S and the data line D3. The first sub pixel P1 is arranged between the data line D1 and the power line VDD1. The second sub pixel P2 is arranged between the power line VDD1 and the data line D2. The third sub pixel P3 is arranged between the data line D3 and the power line VDD2.

The first sub pixel P1, the second sub pixel P2, and the third sub pixel P3 are further horizontally divided into two secondary sub pixels respectively by the scan line S. For example, the first sub pixel P1 is divided into a first secondary sub pixel 210 and a second secondary sub pixel 220 by the scan line S, the second sub pixel P2 is divided into a third secondary sub pixel 230 and a fourth secondary sub pixels 240 by the data line scan line S, and the third sub pixel P3 is divided into a fifth secondary sub pixel 250 and a sixth secondary sub pixel 260 by the scan line S. The first secondary sub pixel 210, the third secondary sub pixel 230, and the fifth secondary sub pixel 250 are arranged at a side of the scan line S. The second secondary sub pixel 220, the fourth secondary sub pixel 240, and the sixth secondary sub pixel 260 are arranged at another side of the scan line S.

The first secondary sub pixel 210 to the sixth secondary sub pixel 260 can be disposed with organic light emitting materials with different light emitting characteristics according to different requirements. For example, the first secondary sub pixel 210 in the first sub pixel P1 can be corresponding to dark red, and the second secondary sub pixel 220 in the first sub pixel P1 can be corresponding to light red; the third secondary sub pixel 230 in the second sub pixel P2 can be corresponding to dark green, and the fourth secondary sub pixel 240 in the second sub pixel P2 can be corresponding to light green; the fifth secondary sub pixel 250 in the third sub pixel P3 can be corresponding to dark blue, and the sixth secondary sub pixel 260 in the third sub pixel P3 can be corresponding to light blue. In some embodiment, the third secondary sub pixel 230 in the second sub pixel P2 can be disposed with light emitting material for emitting green light, and the fourth secondary sub pixel 240 in the second sub pixel P2 is disposed with light emitting material for emitting yellow light for increasing brightness and color field.

The AMOLED pixel structure 200 further includes a plurality of DTFT1-DTFT6 for driving the secondary sub pixels 210-260. As discuss previously, in order to better mix the color from the secondary sub pixels 110-160, the first secondary sub pixel 110 and the second secondary sub pixel 120 are driven simultaneously; the third secondary sub pixel 130 and the fourth secondary sub pixel 140 are driven simultaneously; the fifth secondary sub pixel 150 and the second secondary sub pixel 160 are driven simultaneously.

By changing the composition and/or the area ratio of the secondary sub pixels 210-260, the light emitting characteristics of the sub pixels P1-P3 can be adjusted. Furthermore, the size of the driving thin film transistors DTFT1-DTFT6 can also be changed for adjusting the light emitting strength of the secondary sub pixels 210-260.

Figure 3:
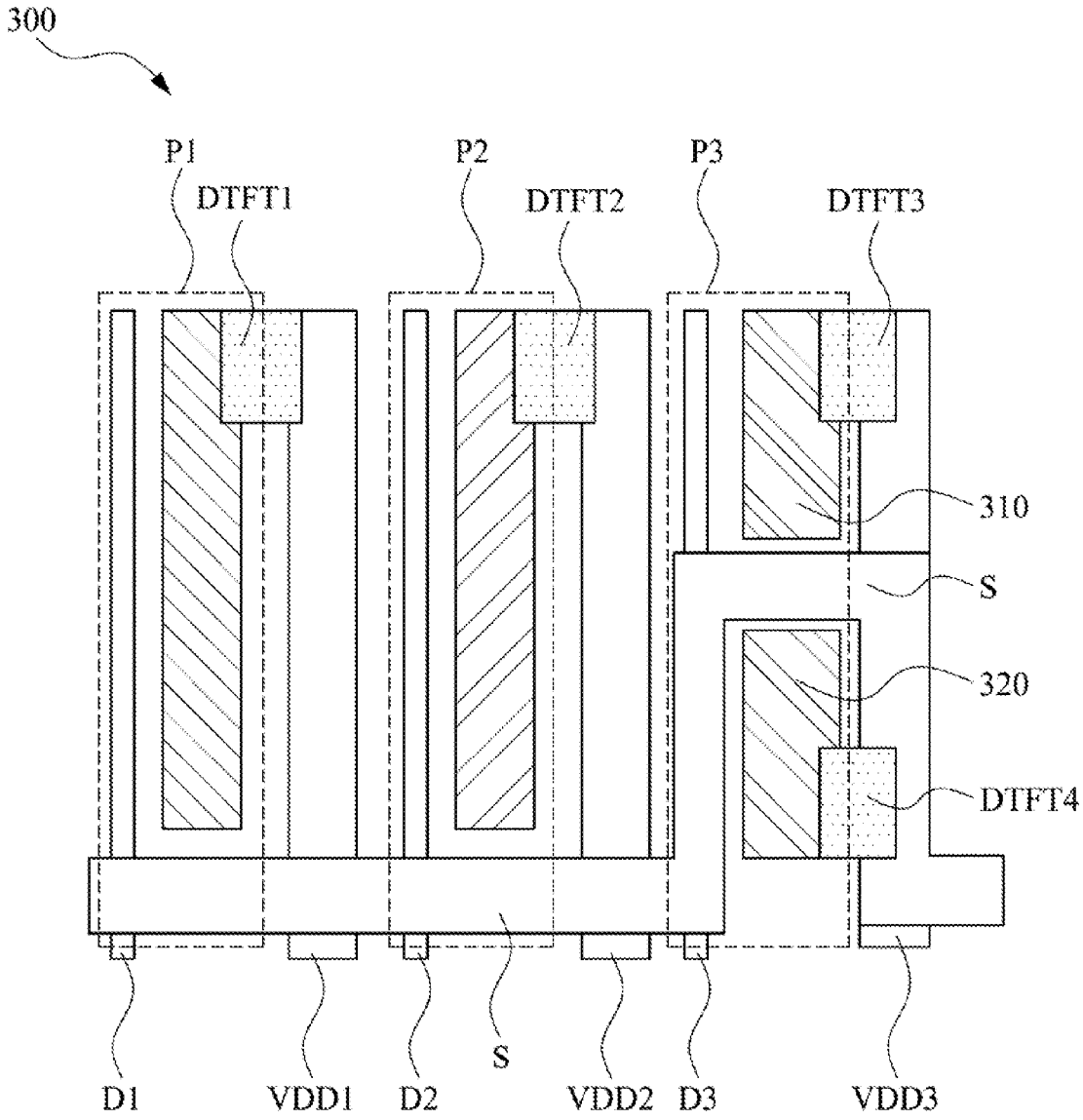

FIG. 3 is a top view of yet another embodiment of an AMOLED pixel structure of the invention. The AMOLED pixel structure 300 includes a scan line S, three power lines VDD1, VDD2, and VDD3 cross the scan line S and are parallel to each other, and three data lines D1, D2, and D3 cross the scan line S and are parallel to each other. The power lines VDD1-VDD3 and the data lines D1-D3 are alternately arranged.

The AMOLED pixel structure 300 in this embodiment includes a first sub pixel P1, a second sub pixel P2, and a third sub pixel P3. The first sub pixel P1 is defined by the scan line S and the data line D1, the second sub pixel P2 is defined by the scan line S and the data line D2, and the third sub pixel P3 is defined by the scan line S and the data line D3. The first sub pixel P1 is arranged between the data line D1 and the power line VDD1. The second sub pixel P2 is arranged between the data line D2 and the power line VDD2. The third sub pixel P3 is arranged between the data line D3 and the power line VDD3.

In this embodiment, only a part of the sub pixels are divided into secondary sub pixels. For example, only the third sub pixel P3 is divided into a first secondary sub pixel 310 and a second secondary sub pixel 320. The first sub pixel P1 and the second sub pixel P2 are not divided.

Namely, the organic light emitting layer has the same and uniform light emitting material at the position corresponding to the first sub pixel P1; the organic light emitting layer has the same and uniform light emitting material at the position corresponding to the second sub pixel P2; the organic light emitting layer has two light emitting materials at the position corresponding to the third sub pixel P3, wherein the light emitting materials are corresponding to the first secondary sub pixel 310 and the second secondary sub pixel 320 respectively. As discussed previously, the first secondary sub pixel 310 and the second secondary sub pixel 320 may emit light of same color system with different brightness, or the first secondary sub pixel 310 and the second secondary sub pixel 320 may emit light of different color systems.

The layout of the scan line S is changed in this embodiment. The section of the scan line S at the third sub pixel P3 is bent, and the third sub pixel P3 is divided into the first secondary sub pixel 310 and the second secondary sub pixel 320 horizontally. The first secondary sub pixel 310 and the second secondary sub pixel 320 are arranged at opposite sides of the scan line S.

The AMOLED pixel structure 300 further includes a plurality of DTFT1-DTFT4 for driving the sub pixels P1, P2 and the secondary sub pixels 310, 320. As discuss previously, in order to better mix color, the first secondary sub pixel 310 and the second secondary sub pixel 320 are driven simultaneously thereby adjusting gray tone, brightness, and the color saturation.

Figure 4:
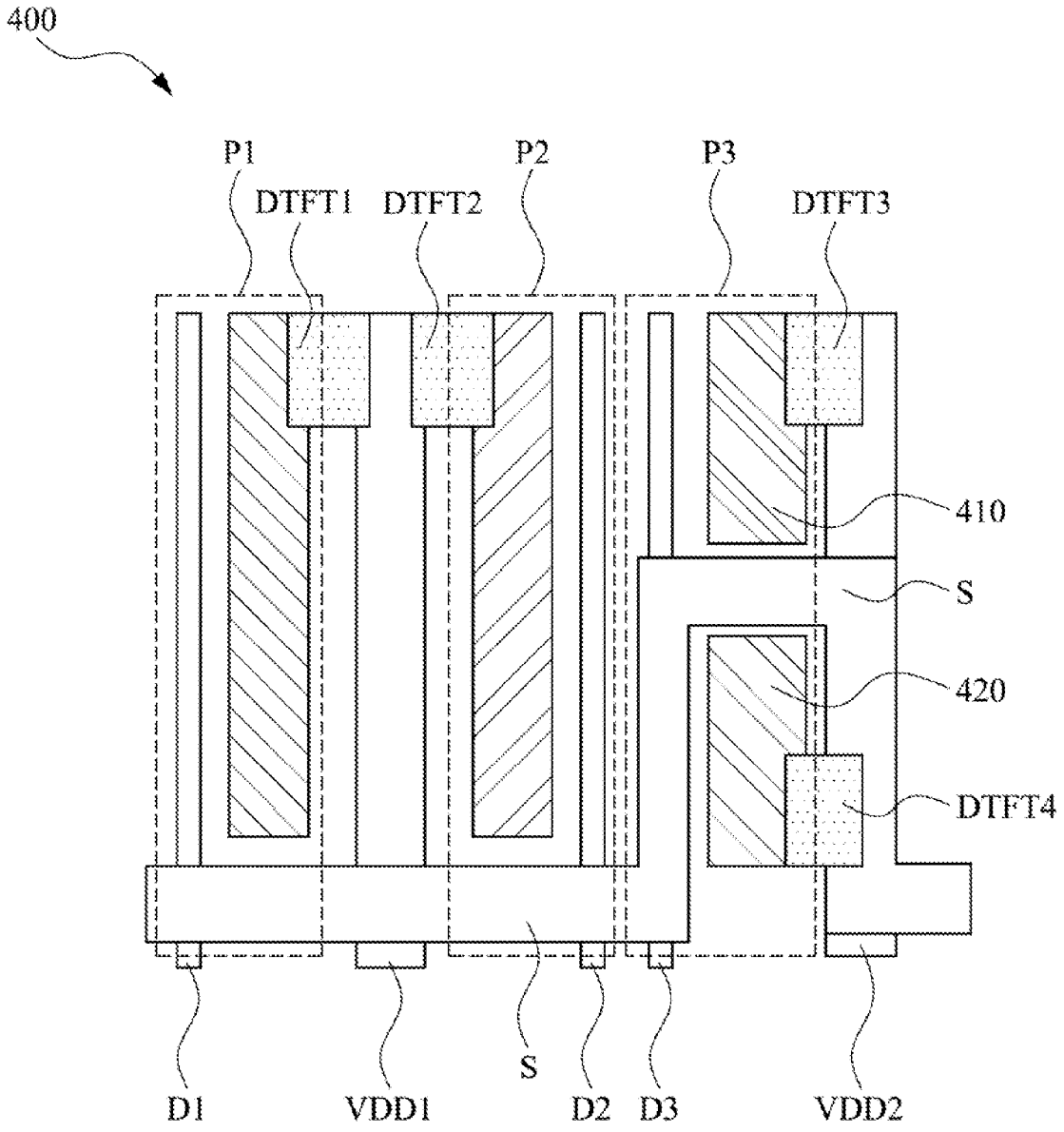

FIG. 4 is a top view of yet another embodiment of an AMOLED pixel structure of the invention. The difference between this embodiment and the previous embodiment is that the AMOLED pixel structure 400 has two power lines VDD1, VDD2. Both the first sub pixel P1 and the second sub pixel P2 use the power line VDD1. The third sub pixel P3 is divided into a first secondary sub pixel 410 and a second secondary sub pixel 420 by the scan line S.

As discussed in the previous embodiment, the composition of the organic light emitting material, the area of the secondary sub pixels 410, 420, and the size of the driving thin film transistors DTFT3, DTFT4 can be adjusted thereby changing the light emitting characteristic of the secondary sub pixels 410, 420.

In the above embodiments, each of the sub pixels in the AMOLED pixel structure is defined by one scan line and one data line. The composition of the organic light emitting material, the area of the secondary sub pixels, and the size of the driving thin film transistors can be adjusted, so that the secondary sub pixels in a single sub pixel may emit light of different light emitting characteristics. However, in order to improve the flexibility of adjusting the light emitting characteristic of the secondary sub pixel, two scan lines can be utilized in a single AMOLED pixel structure, details thereof are discussed in the following embodiment.

Figure 5:
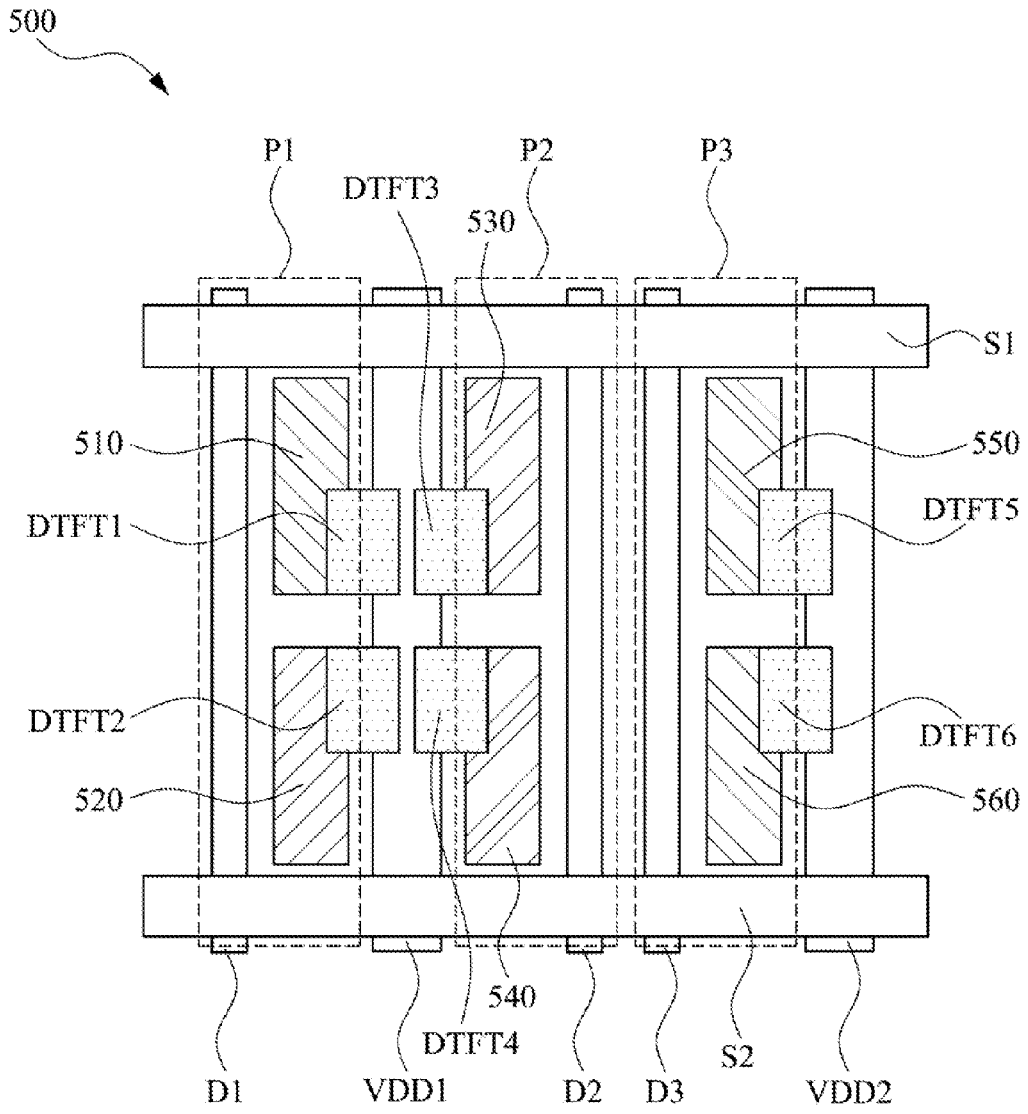

FIG. 5 is a top view of yet another embodiment of an AMOLED pixel structure of the invention. The AMOLED pixel structure 500 includes two scan lines S1, S2, three data lines D1, D2, and D3 cross the scan lines S1, S2 and are parallel to each other, and two power lines VDD1, VDD2 cross the scan lines S1, S2 and are parallel to each other. The power line VDD1 is arranged between the data lines D1 and D2. The data line D3 is arranged next to the data line D2. The power lines VDD1 and VDD2 are arranged at opposite sides of the data lines D2 and D3.

The AMOLED pixel structure 500 in this embodiment includes a first sub pixel P1, a second sub pixel P2, and a third sub pixel P3. The first sub pixel P1 is defined by the scan lines S1, S2 and the data line D1, the second sub pixel P2 is defined by the scan lines S1, S2 and the data line D2, and the third sub pixel P3 is defined by the scan lines S1, S2 and the data line D3. The first sub pixel P1 and the second sub pixel P2 use the power line VDD1.

In this embodiment, the first sub pixel P1 includes a first secondary sub pixel 510 and a second secondary sub pixel 520. The first secondary sub pixel 510 is connected to the scan line S1, and the second secondary sub pixel 520 is connected to the scan line S2. The second sub pixel P2 includes a third secondary sub pixel 530 and a fourth secondary sub pixel 540. The third secondary sub pixel 530 is connected to the scan line S1, and the fourth secondary sub pixel 540 is connected to the scan line S2. The third sub pixel P3 includes a fifth secondary sub pixel 550 and a sixth secondary sub pixel 560. The fifth secondary sub pixel 550 is connected to the scan line S1, and the sixth secondary sub pixel 560 is connected to the scan line S2.

The AMOLED pixel structure 500 further includes driving thin film transistors DTFT1-DTFT6 for driving the secondary sub pixels 510-560 respectively. The first secondary sub pixel 510 and the second secondary sub pixel 520 can be driven individually or simultaneously. The third secondary sub pixel 530 and the fourth secondary sub pixel 540 can be driven individually or simultaneously. The fifth secondary sub pixel 550 and the sixth secondary sub pixel 560 can be driven individually or simultaneously. The color emitted by the secondary sub pixels 510-560 can be mixed to adjust the color performance of the sub pixels P1-P3.

The composition and/or the area ratio of the secondary sub pixels 510-560 can be utilized for providing the sub pixels P1-P3 different light emitting characteristics, the size of the driving thin film transistors DTFT1-DTFT6 can also be designed for adjusting the light emitting strength of the secondary sub pixels 510-560.

Additionally, the sub pixels P1-P3 are connected to two scan lines S1, S2, so that the different data voltages can be provided to the secondary sub pixels 510-560 respectively thereby adjusting the light emitting characteristics of the secondary sub pixels 510-560. For example, when the scan line S1 is conducted, the data lines D1, D2, and D3 can provide a voltage to the first secondary sub pixel 510, the third secondary sub pixel 530, and the fifth secondary sub pixel 550; when the scan line S2 is conducted, the data lines D1, D2, and D3 can provide another voltage to the second secondary sub pixel 520, the fourth secondary sub pixel 540, and the sixth secondary sub pixel 560. Thus the light emitting characteristics of the secondary sub pixels 510-560 can be adjusted.

Table 1 shows light emitting characteristics of a conventional AMOLED display before gamma adjustment. Table 2 shows light emitting characteristics of the conventional AMOLED display after gamma adjustment. Table 3 shows light emitting characteristics of an embodiment of the AMOLED display using the AMOLED pixel structure 400 as shown in FIG. 4 after gamma adjustment.

TABLE 1

Light emitting characteristics of a conventional AMOLED display before gamma adjustment

| CIE | x | Y | nits |
|---|---|---|---|
| R | 0.6921 | 0.3042 | 115.3 |
| G | 0.3444 | 0.5843 | 170.6 |
| B | 0.1697 | 0.1918 | 67.3 |
| W | 0.4134 | 0.320 | 320 |
| NTSC | 58.60% | CR | 8000 |

TABLE 2

Light emitting characteristics of the conventional AMOLED display after gamma adjustment

| CIE | x | Y | nits |
|---|---|---|---|
| R | 0.6971 | 0.2993 | 33.21 |
| G | 0.3492 | 0.5796 | 105.8 |
| B | 0.1703 | 0.1904 | 56.86 |
| W | 0.316 | 0.3271 | 190 |
| NTSC | 58.64% | CR | 4750 |

As shown in Table 1 and Table 2, the conventional AMOLED display is gamma adjusted in order to fit the tone standard, but the brightness thereof is decreased from 320 nits to 190 nits. After the gamma adjustment, the brightness lost is about 40%, and the NTSC (National Television Standards Committee) is also dropped from 8000 to 4750. Therefore, it is difficult to satisfy brightness, color saturation, and tone in the conventional AMOLED display due to the limitation of organic light emitting material performance.

TABLE 3

Light emitting characteristics of an embodiment of the AMOLED display using the AMOLED pixel structure as shown in FIG. 4 after gamma adjustment

| CIE | X | Y | nits |
|---|---|---|---|
| R | 0.6971 | 0.2993 | 65 |
| G | 0.3492 | 0.5796 | 165 |
| B1 | 0.1703 | 0.1904 | 34 |
| B2 | 0.1696 | 0.2443 | 100 |
| W | 0.314625 | 0.32986 | 364 |
| NTSC | 55.58% | CR | 9100 |

Table 3 shows light emitting characteristics of an embodiment of the AMOLED display using the AMOLED pixel structure 400 as shown in FIG. 4 after gamma adjustment. In this embodiment, the area of the first secondary sub pixel 410 and the second secondary sub pixel 420 are the same. The first secondary sub pixel 410 is disposed with organic light emitting material for emitting bright blue light, and the second secondary sub pixel 420 is disposed with organic light emitting material for emitting dark blue light. By using the design of the embodiment, as shown in Table 3, the brightness is kept at 364 nits, and the NTSC becomes 9100 after the AMOLED display is gamma adjusted. Namely, the AMOLED display using the present design can fit the requirements of brightness, color saturation, and tone.

As discussed in above embodiments, single sub pixel in the present disclosure may be disposed with organic light emitting materials with different light emitting characteristics, such as different light emitting efficiencies or different tones, such that the light emitted from the secondary sub pixels can be mixed to adjust the gray tone of the sub pixels. Thus the brightness of the AMOLED display can be kept after gamma adjustment. Furthermore, the area ratio of the secondary sub pixels can be the same or different and/or the size of the driving thin film transistors for driving the secondary sub pixels can be the same or different to adjust the gray tone of the sub pixels by mixing the light from the secondary sub pixels. Additionally, single sub pixel may be disposed with two scan lines for further improving design flexibility of the secondary sub pixels. Moreover, the secondary sub pixels in the single sub pixel may be disposed with organic light emitting material for emitting different colors, for example, adding a yellow color, such that the brightness can be increased and the color field can be broadened.

Although the single sub pixel is divided into two secondary sub pixels, the single sub pixel can be divided into three or more secondary sub pixels if possible. The number of the secondary sub pixels should not be limited by the above embodiments.

What is claimed is:

1. An active matrix organic light emitting diode (AMOLED) pixel structure, comprising:

a plurality of sub pixels, wherein at least one of the sub pixels comprises two secondary sub pixels, and the secondary sub pixels are disposed with organic light emitting materials with different light emitting characteristics respectively, so that the secondary sub pixels emit different lights, wherein the secondary sub pixels in each sub pixel comprising the secondary sub pixels are divided by a data line, each sub pixel is a red sub pixel, a green sub pixel, or a blue sub pixel, said at least one of the sub pixels has a length and a width, each of the two secondary sub pixels extends along the length of said at least one of the sub pixels, and said at least one of the sub pixels comprises a data line that extends along the length thereof, the data line being disposed between the two secondary sub pixels along at least the entire length of the two secondary sub pixels to divide the two secondary sub pixels.

2. The active matrix organic light emitting diode pixel structure of claim 1, wherein the secondary sub pixels in each sub pixel comprising the secondary sub pixels are driven by the same data line simultaneously.

3. The active matrix organic light emitting diode pixel structure of claim 1, wherein the secondary sub pixels in each sub pixel comprising the secondary sub pixels are disposed with organic light emitting materials with different efficiencies.

4. The active matrix organic light emitting diode pixel structure of claim 1, wherein the secondary sub pixels in each sub pixel comprising the secondary sub pixels are disposed with organic light emitting materials with different hues.

5. The active matrix organic light emitting diode pixel structure of claim 1, wherein the secondary sub pixels in each sub pixel comprising the secondary sub pixels are disposed with organic light emitting materials with different colors.

6. The active matrix organic light emitting diode pixel structure of claim 1, wherein an area of each secondary sub pixels in the sub pixel comprising the secondary sub pixels is the same.

7. The active matrix organic light emitting diode pixel structure of claim 1, wherein an area of each secondary sub pixels in the sub pixel comprising the secondary sub pixels is different from each other.

8. The active matrix organic light emitting diode pixel structure of claim 1, further comprising a plurality of driving thin film transistors for driving the secondary sub pixels.

9. The active matrix organic light emitting diode pixel structure of claim 8, wherein a size of each driving thin film transistors is the same.

10. The active matrix organic light emitting diode pixel structure of claim 8, wherein a size of each driving thin film transistors is different from each other.

11. The active matrix organic light emitting diode pixel structure of claim 1, wherein the secondary sub pixels in each sub pixel comprising the secondary sub pixels are divided by a scan line.

12. The active matrix organic light emitting diode pixel structure of claim 1, wherein each sub pixel comprising the secondary sub pixels is disposed with a data line and two scan lines, and the scan lines are arranged corresponding to the secondary sub pixels.

13. The active matrix organic light emitting diode pixel structure of claim 1, wherein each sub pixel is a red sub pixel, a green sub pixel, or a blue sub pixel, and the two secondary sub pixels of said at least one of the sub pixels are respectively a dark red secondary sub pixel and a light red secondary sub pixel, a dark green secondary sub pixel and a light green secondary sub pixel, or a dark blue secondary sub pixel and a light blue secondary sub pixel.

14. The active matrix organic light emitting diode pixel structure of claim 13, wherein the two secondary sub pixels of said at least one of the sub pixels are immediately adjacent to each other without any other secondary sub pixel intervening therebetween.

* * * * *